US005250918A

United States Patent [19]

Edds et al.

[11] Patent Number: 5,250,918

[45] Date of Patent: Oct. 5, 1993

[54] AUTOMATIC MINIATURE CIRCUIT BREAKER WITH Z-AXIS ASSEMBLAGE CURRENT RESPONSE MECHANISM

[75] Inventors: Thomas A. Edds, Cedar Rapids, Iowa; James V. Fixemer, Denton, Nebr.; Matthew D. Sortland, Swisher; John M. Winter, Cedar Rapids, both of Iowa; Charles H. Wagner, Hickman; Guntis U. Strauss, Lincoln, both of Nebr.

[73] Assignee: Square D Company, Palatine, Ill.

[21] Appl. No.: 878,676

[22] Filed: May 5, 1992

[51] Int. Cl.[5] ..... H01H 75/12

[52] U.S. Cl. ..... 335/35; 335/21

[58] Field of Search ..... 375/23, 24, 25, 35–45, 375/21

[56] References Cited

U.S. PATENT DOCUMENTS

| | | | |
|---|---|---|---|
| 2,902,560 | 9/1959 | Stanback et al. | 335/35 |
| 3,760,308 | 9/1973 | Misencik et al. | 335/43 |
| 4,156,219 | 5/1979 | Coleman | 335/23 |

*Primary Examiner*—Lincoln Donovan

*Attorney, Agent, or Firm*—Larry I. Golden; Kareem M. Irfan

[57] ABSTRACT

An improved miniature circuit breaker is provided which is adapted to improved automatic assembly of all components thereof. Key components of the breaker are individually and collectively designed to be susceptible to total Z-axis assembly. In particular, the magnetic-yoke and armature which comprise the current response mechanism for the circuit breaker are designed to interact with each other so that the magnetic armature can easily be Z-axis assembled onto the magnetic yoke.

4 Claims, 14 Drawing Sheets

AUTOMATIC MINIATURE CIRCUIT BREAKER WITH Z-AXIS ASSEMBLAGE CURRENT RESPONSE MECHANISM

FIELD OF THE INVENTION

This invention relates generally to apparatus for making and breaking electrical circuits and, more particularly, to a miniature circuit breaker designed for automated Z-axis assembly and automatically operable in response to current overloads.

BACKGROUND OF THE INVENTION

Miniature circuit breakers are well known in the prior art. An illustrative circuit breaker design is disclosed in U.S. Pat. No. 2,902,560 which is assigned to the same assignee as the present application, and the disclosure in which is incorporated herein by reference. As illustrated in the '560 patent, the basic miniature automatic circuit breaker comprises a base and cover, a line terminal and a load terminal and an electrical circuit therebetween, a stationary contact, a movable contact secured to a contact carrier which is movable between a contact OPEN position and a contact CLOSED position to open or close the electrical circuit, an arc interrupting chamber, an operating mechanism for opening and closing the contacts, and a current responsive trip mechanism which releases the operating mechanism to open the contacts in response to a sustained moderate overload or an instantaneous short circuit.

The assembly of these circuit breakers is often labor intensive and not easily automated. Such circuit breakers include various elements or component assemblies which are not susceptible to convenient automatic assembly. For instance, the components installed in the circuit breaker base include a load terminal welded to a bimetal element having a magnetic yoke welded thereto. A magnetic armature having an ambient temperature compensation bimetal is supported on the magnetic yoke. However, these and other components of the illustrated type of circuit breaker are incapable of being Z-axis assembled into the circuit breaker base.

The miniature circuit breaker illustrated in U.S. Pat. No. 4,616,200, which is also assigned to the assignee of the present application and incorporated herein by reference, represents a design which is better adapted to automated assembly. However, several components of the circuit breaker shown therein are still not particularly adapted for Z-axis assembly. As an example, the temperature compensation bimetal shown in the '200 patent extends beyond the length of the armature element and includes an offset end which obstructs assembly. The presence of such components makes the overall circuit breaker incapable of total Z-axis assembly.

Accordingly, there exists a distinct need for a circuit breaker design which avoids such and other related disadvantages inherent with the design and Z-axis assembly of conventional circuit breakers.

SUMMARY OF THE INVENTION

In view of the foregoing, it is an overall object of the present invention to provide an improved miniature circuit breaker which is adapted to improved automatic assembly of all components thereof.

A more specific object of this invention is to provide a circuit breaker design whereby components thereof, particularly the magnetic assembly comprising the yoke and armature, can be Z-axis assembled.

Another specific object of this invention is to provide an improved circuit breaker of the above type wherein the temperature compensation bimetal element is specially adapted for convenient Z-axis assembly with other circuit breaker elements.

A further related object of the subject invention is to provide such an improved circuit breaker which is adapted to convenient assembly of the flexible conductor about the magnetic yoke in order to facilitate Z-axis assembly of the breaker.

The above and other objectives are realized, in accordance with the Principles of the present invention, by the provision of a miniature circuit breaker design wherein key components or elements are individually and collectively designed to be susceptible to total Z-axis assembly. According to an important aspect of this invention, the magnetic yoke and armature which comprise the magnetic assembly for the circuit breaker are designed to interact with each other such that the magnetic armature can easily be Z-axis assembled onto the magnetic yoke without requiring the complicated insertion motions otherwise necessary with conventional breaker designs.

In accordance with another aspect of the subject invention, the ambient temperature compensation bimetal element used in the circuit breaker is designed for Z-axis assembly as well as simplified fabrication and improved control of dimensions. According to a preferred embodiment, the bimetal element is designed as a generally L-shaped element having only two 90-degree bends whereby fabrication is simplified because of the simpler design and resultant reduction in material; more importantly, the bimetal element interacts with the armature element so as to be capable of being Z-axis assembled.

Figure 1:
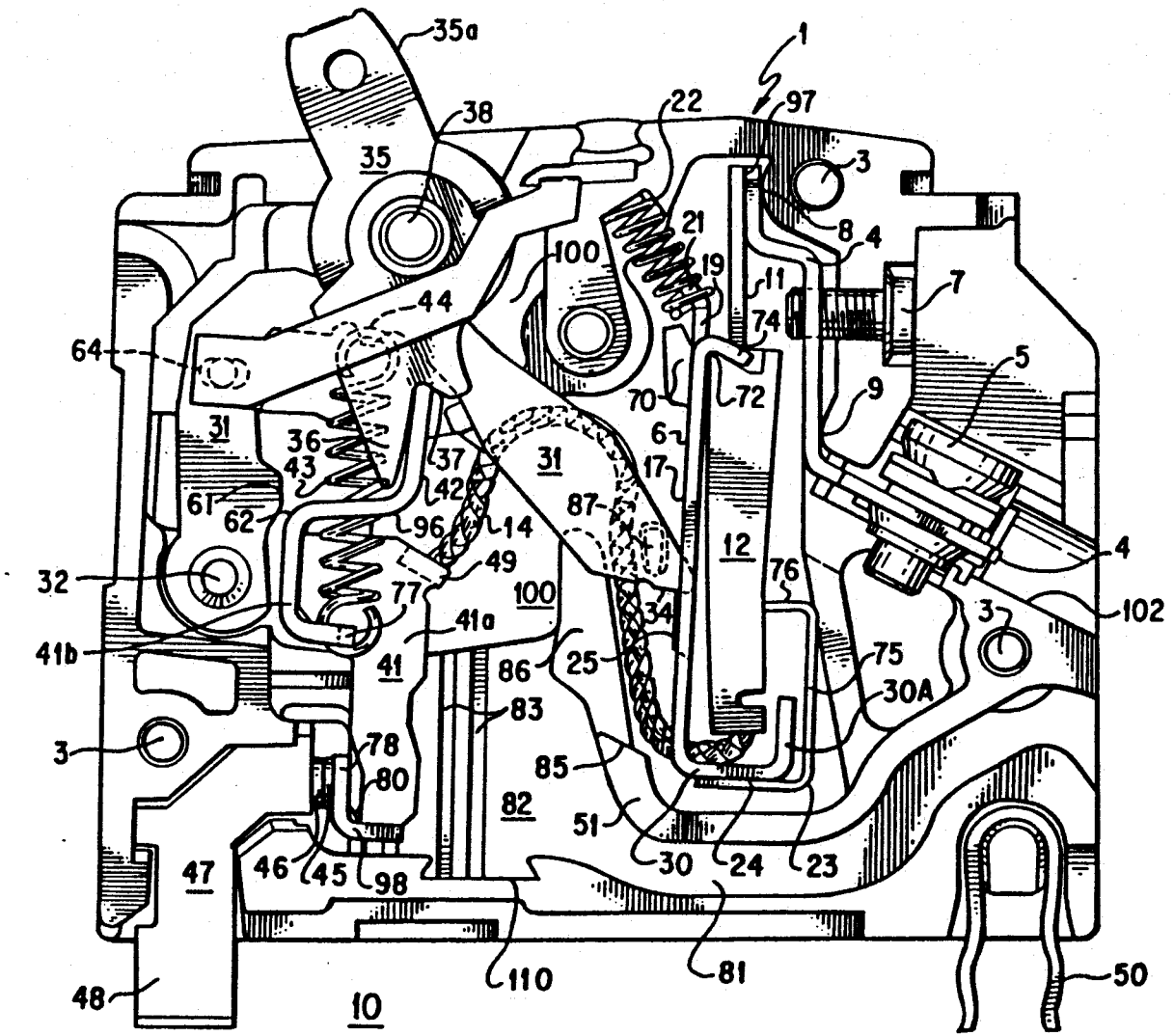
FIG. 1 is a side view of the circuit breaker constructed in accordance with the present invention with the cover removed showing the operating mechanism in the CLOSED position.

While the invention is susceptible to various modifications and alternative forms, specific embodiments thereof have been shown by way of example and will be described in detail herein. The intention, however, is not to limit the invention to the particular forms disclosed, but, instead, to cover all modifications, equivalents, and alternatives falling within the scope of the invention as covered by the claims attached hereto.

DETAILED DESCRIPTION OF THE PREFERRED EMBODIMENT

The figures show the circuit breaker 10 of the present invention comprising an open sided base 1 of molded insulating material having a bottom base wall 100 and molded recesses and barriers for providing support for circuit breaker components which are automatically Z-axis assembled therein. A cover 2 of molded insulating material having a bottom cover wall 101 and providing complementary recesses and barriers closes the open side of the base 1 and is mounted thereon by means of a plurality of rivets 3. Together the base 1 and cover 2 form an enclosure or circuit breaker casing. Both the base and cover are provided with top and bottom openings through which extend operating and connecting members of the circuit breaker as will be described.

Figure 2:
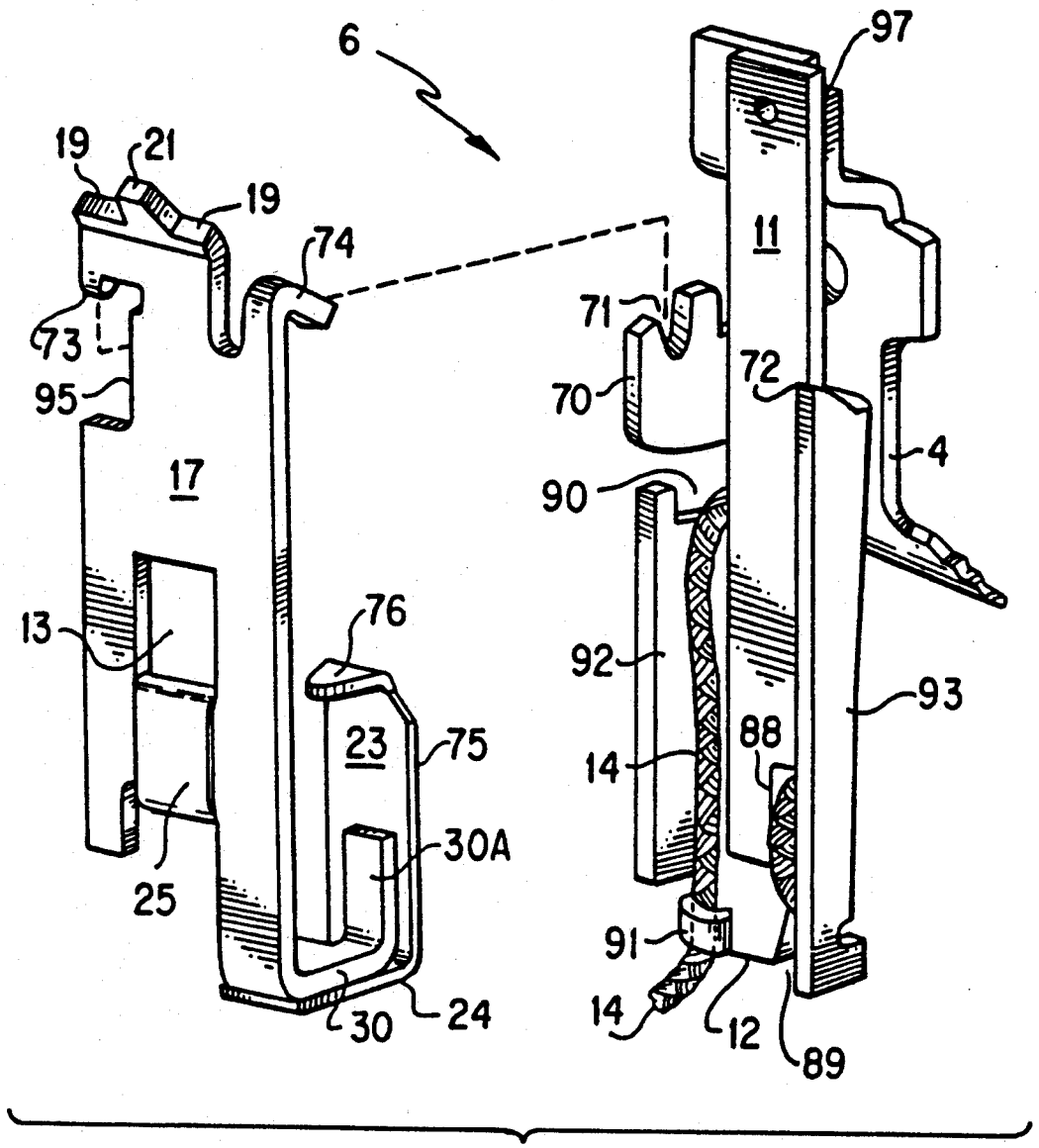
FIG. 2 is an exploded, perspective view of the magnetic assembly showing the load terminal, bimetal, magnetic yoke including the flexible conductor, and magnetic armature used within the circuit breaker of FIG. 1.

Referring to FIGS. 1 and 2, in one end of the insulating base 1 and supported by barriers established by portions of the base, is a load terminal 4 which is provided at its outside end with a terminal screw 5 and having secured thereto, at its inside end, the current response mechanism 6 of the circuit breaker. An adjustable screw 7 extends through a slot in the base and threadingly engages the conducting load terminal 4 in the interior of the base 1 with the head thereof operating against the slotted portion of the base 1 to provide an adjustment for the thermal calibration of the automatic circuit breaker.

The conducting load terminal 4 bears at one end against a nib 8 in the insulating base 1 and substantially at its mid point against a shoulder 9 on a portion of the insulating base 1 so that rotation of the adjustment screw 7 operates to determine the angular position of the current responsive trip mechanism 6 within the interior of the base 1. The terminal end of the conducting terminal 4 is suitably supported between supporting ribs 102 molded in the base and cover as generally shown in FIG. 1.

The current response mechanism 6 supported on the interior end of the conducting load terminal 4 constitutes a current responsive bimetallic member 11 attached by suitable means, such as welding, to the load terminal 4 at one end 97 and having fixed thereto at its other end at area 88, by means such as welding, a magnetic yoke member 12 of generally U-shaped construction. As best shown in FIG. 2, the magnetic yoke member 12 is provided with a yoke tab 70 having a yoke cradle slot 71 defined thereupon, the tab 70 being formed on a first side leg 92 of the U-shape. At an opposite side leg 93 of the U-shaped yoke member, a yoke pivot or support section 72 is defined.

A flexible conductor in the form of a standard or "pigtail" wire 14 is welded to the bimetal at the weld area 88 and then passes through a first notch 89 in the magnetic yoke and bends rearwardly so that the pigtail rides along the flat rear surface of the magnetic yoke 12. The flexible conductor then loops forward through a second notch 90 and runs along the inside of the first side leg 92 of the U-shape magnetic yoke and is securely crimped in place with a wire restraint 91 being bent over the pigtail 14. The aforementioned method of attaching the pigtail 14 to the bimetal/yoke assembly is designed for automated assembly. The pigtail is welded to the bimetal at the welded area 88 on the reverse side from where the yoke is welded to the bimetal. In the assembly process, after that weld connection is made, the yoke is rotated 360 degrees with the pigtail held in place to wrap the pigtail around the yoke as shown. As the pigtail travels away from the weld area, it enters the first notch 89 on the front side of the yoke and travels along the back side of the yoke until it travels through the second notch 90. It then travels along the inside area of the yoke where it passes the wire restraint 91, which is formed over the pigtail as it passes through that area.

With the above arrangement, automation of the assembly process is facilitated because the pigtail wire can be held in place while the yoke is turned 3600 and the coil wire is wrapped in place by using the open access areas provided by the first and second notches 89 and 90. This arrangement makes possible the use of standard pigtail wire for the entire wire length extending from the bimetal member to the blade or contact carrier. This is an advantage because the pigtail wire is more easily controlled compared to the conventional use of magnet wire which is rigid and difficult to handle. Also, conventional designs using magnetic wire require an additional welding operation for interfacing of the magnetic wire to the stretch of pigtail wire essential for the area about the yoke where flexibility is essential. In addition, the use of pigtail wire as described above permits the trip coil to withstand increased energy through the breaker, thereby increasing overall performance.

A movable magnetic armature member 17 having a central cutout 18 is pivotably supported on the magnetic yoke 12 by an armature hook or rocker 73 and an outwardly extending armature pivot tab 74, formed on the armature member 17. The rocker 73 and the pivot tab 74 supportingly engage the corresponding yoke tab slot 71 and yoke pivot support 72, respectively. The magnetic armature 17 has a generally flat front surface or face plate 99 and is formed so as to extend toward the bottom end of the circuit breaker substantially parallel to the magnetic yoke 12. The armature 17 has outwardly extending shoulder portions 19 at one end with an arm 21 integrally formed therebetween that extends toward the upper end of the circuit breaker at an offset angle away from the bimetallic member 11 and a hook-shaped extension 30 is formed at the opposite end of the armature. A metal latch clip 25 is bent over the lower surface of cutout 18 at one end and bent over at the lower center portion of the armature 17 at the opposite end thereof so as to produce a smooth, hard latch surface for cooperation with the face of a trip lever 31 at a latched end 34 thereof as it moves to a released position and, particularly, as it is moved back to a latched position in a relatching movement.

A helical coil spring 22 engages the magnetic armature member 17 at the shoulder portions 19 and about the arm 21 at one end and, at the other end, is supported against the insulating base member 1 in a suitable recess provided therein. Secured to the lower end of the armature member 17 is a generally L-shaped ambient temperature compensation bimetal member 23 having a lower portion 24 thereof welded to the armature hook shaped extension 30 and an upwardly extending leg portion 75 substantially perpendicular to the lower portion 24. An ambient temperature compensation bimetal tab 76, extending towards the armature body, is bent approximately 90 degrees at the top of the upwardly extending leg portion 75 of the ambient temperature compensation bimetal 23.

Figure 3:
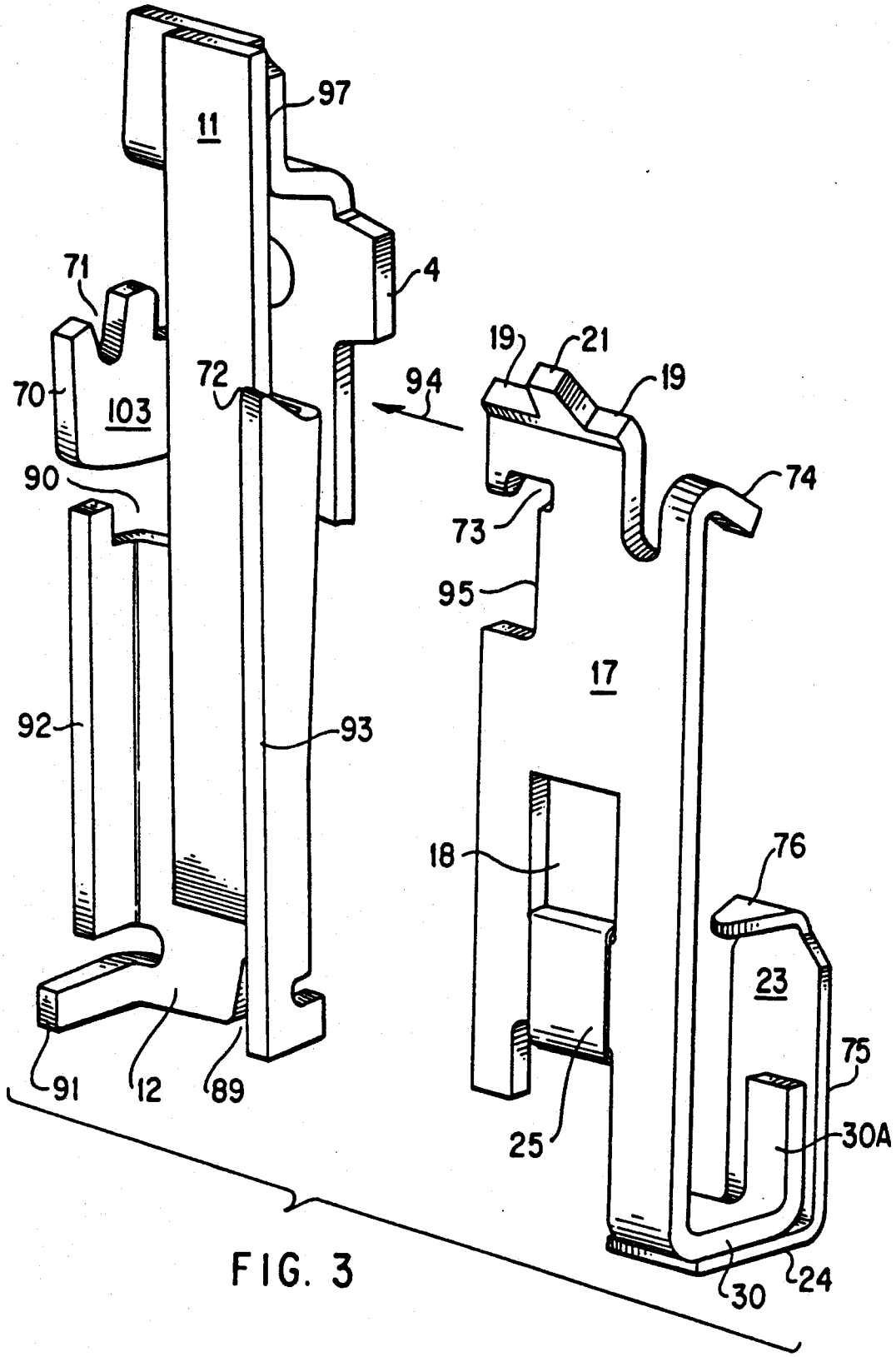
FIG. 3 is an exploded, perspective view of the magnetic assembly showing the load terminal, bimetal magnetic yoke without the flexible conductor, and magnetic armature.
Figure 12:
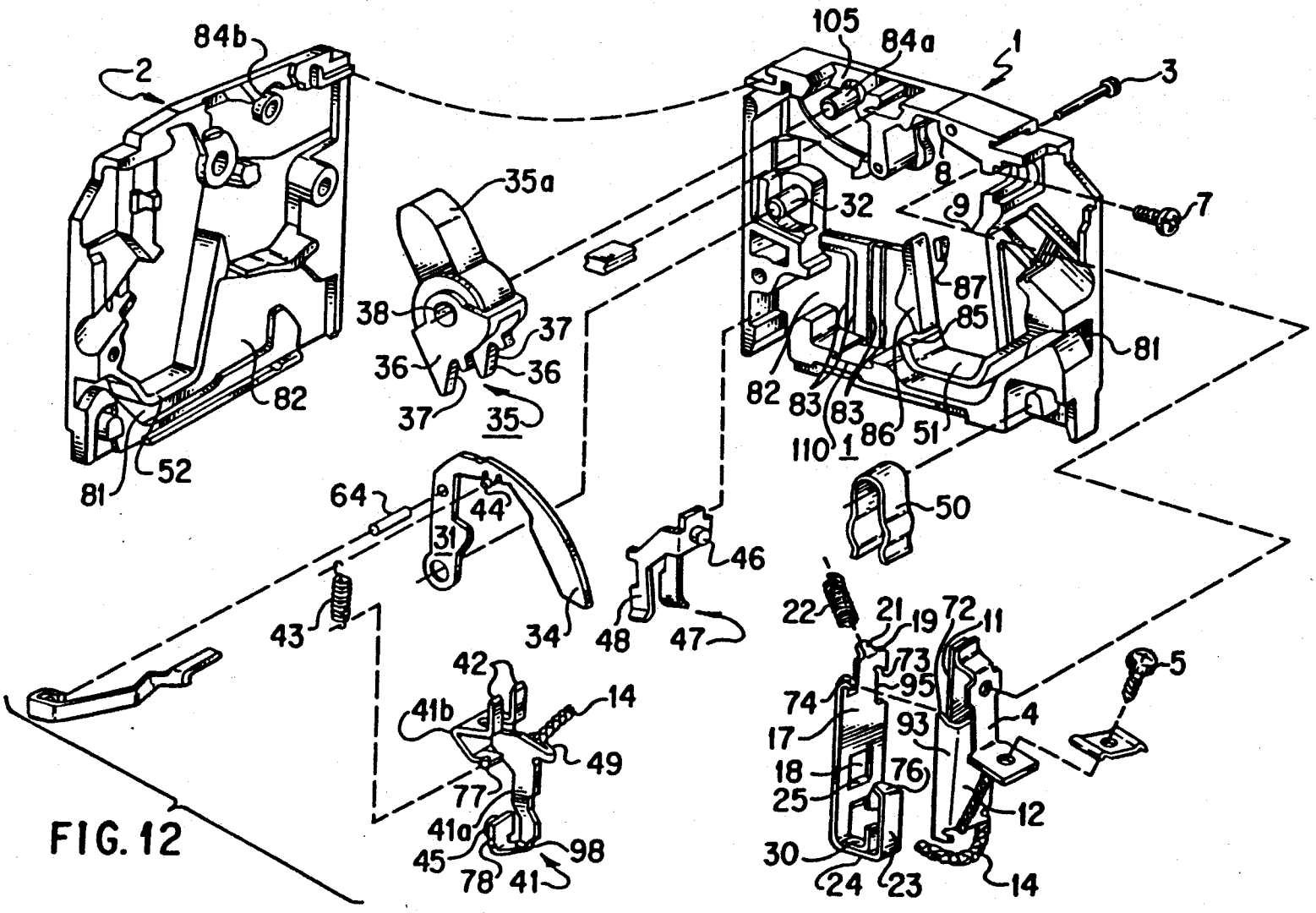
FIG. 12 is an exploded, perspective view of the components used within the circuit breaker of FIG. 1.
Figure 13:
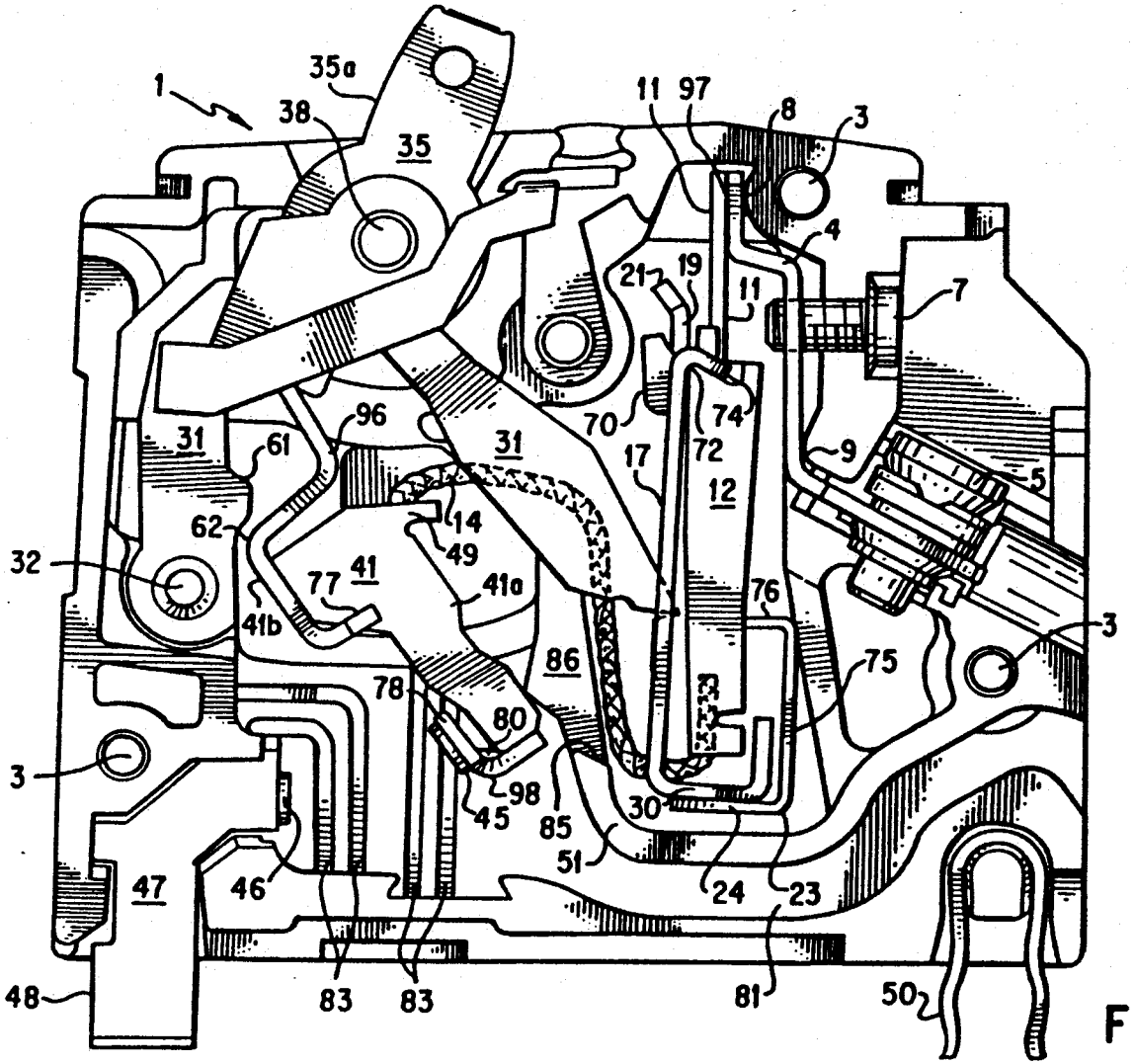
FIG. 13 is a side view of the circuit breaker as shown in FIG. 1 with the cover removed showing the operating mechanism in the OPEN position.

Referring now to FIGS. 1, 3, and 12, the method of Z-axis assembling the magnetic assembly will now be described. The combination of the load terminal 4, the bimetal member 11, and the magnetic yoke assembly 12 including the pigtail 14 is first placed into the circuit breaker base 1. The magnetic armature 17 is then moved toward the magnetic yoke 12 in the direction of arrow 94 (FIG. 3). The magnetic armature rear surface, which is opposite the front surface 99, slides over the top of second side leg 93 of the magnetic yoke. As the magnetic armature 17 continues to move in the direction of the arrow 94, the armature hook 73 engages the yoke tab slot 71 while the ambient temperature compensation bimetal tab 76 slides under the bottom of the magnetic yoke 12. Armature stop surface 95 comes to rest against the inside surface 103 of the yoke tab 70 while the armature pivot 74 slides over and engages the yoke pivot support 72. Finally, the helical coil spring 22 is inserted, as previously described, biasing the magnetic armature 17 downward so that the bottom of the armature hook 73 firmly engages the yoke tab slot 71 thereby locking in the armature and yoke so that they can not be disengaged. The helical coil spring 22 also biases the armature 17 forward so that the ambient temperature compensation bimetal tab 76 contacts the rear surface of the magnetic yoke 12 as shown in FIG. 1.

The hook-shaped extension 30 also includes a vertical extension 30A running substantially parallel to the upwardly extending leg portion 75 of the lower portion 24 of the bimetal member 23. This vertical extension 30A functions as a safety hook to retain the armature 17 in supported relation upon the magnetic yoke 12, even if the ambient compensator 23, which normally provides the support function, is for some reason detached from the extension 30.

The designed shape of the compensator member 23 is such that only two bends of approximately 900 each exist between the compensator/armature interface point and the contact point of the bimetal tab 76 to the yoke 12. This is advantageous compared to the conventional U-shaped compensator design because the L-shaped compensator uses less material, is easier to fabricate and lends itself to increased control of dimensions and tolerances.

Figure 8:
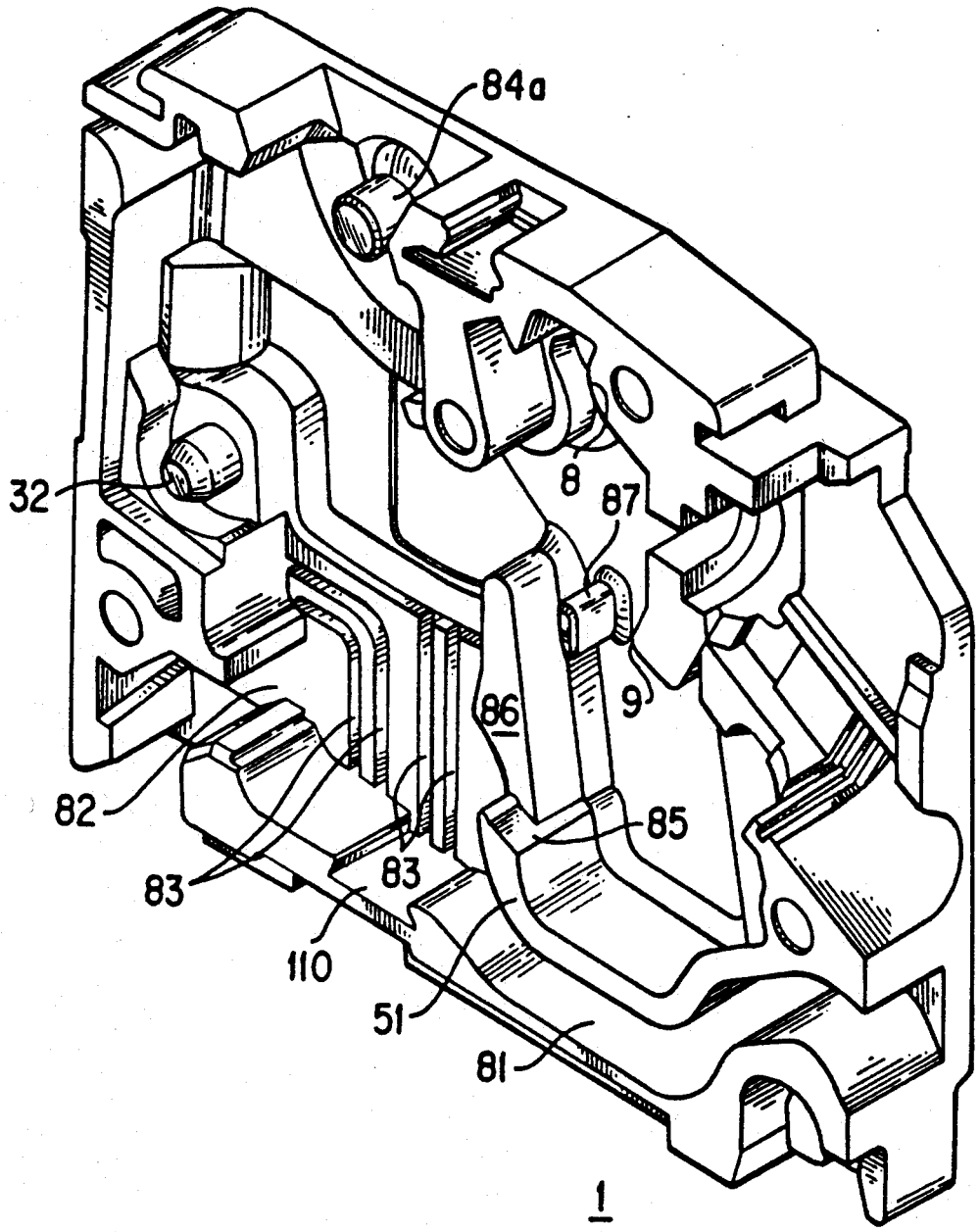
FIG. 8 is a front perspective view of the molded base used for the circuit breaker of FIG. 1.
Figure 9:
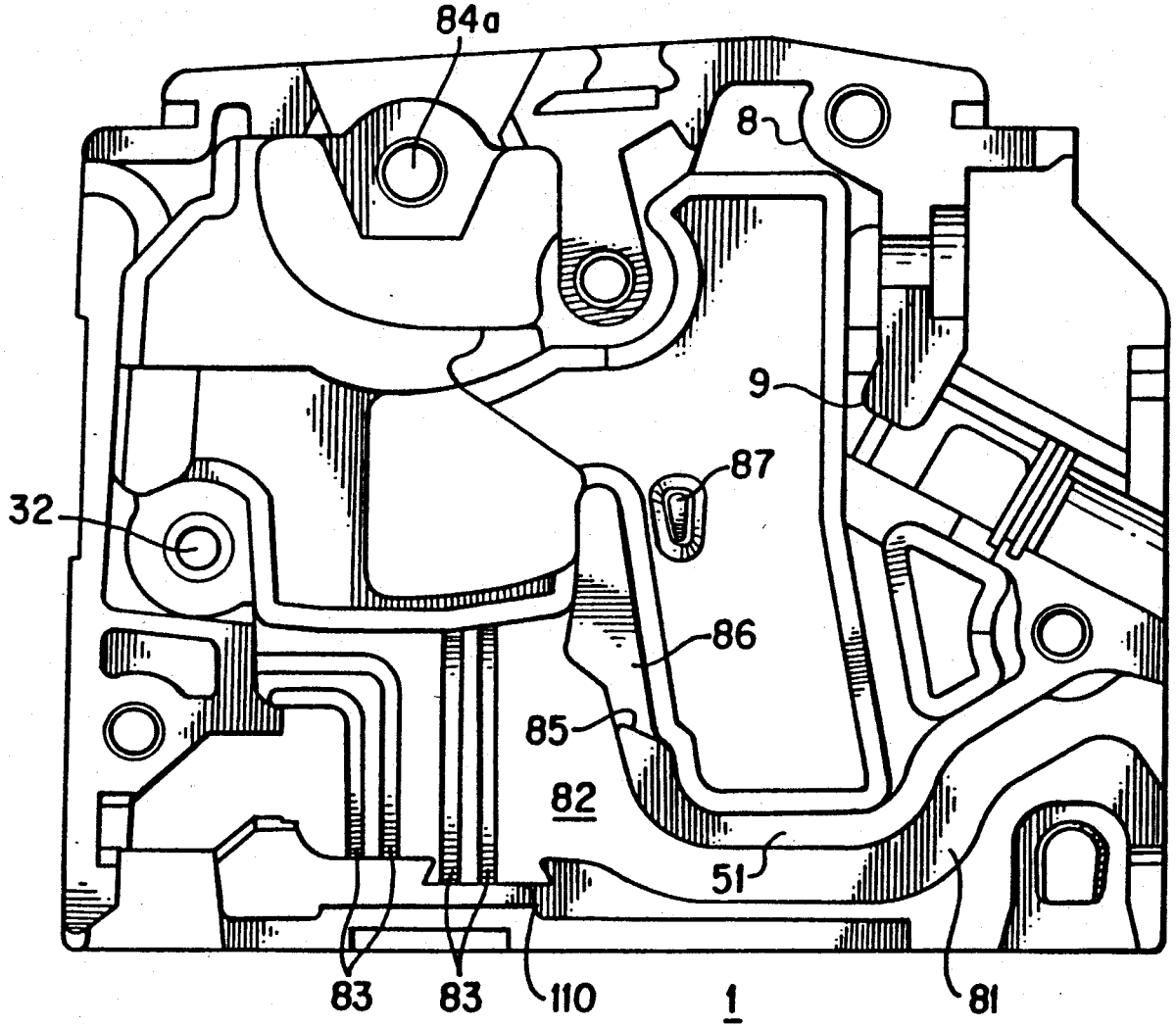
FIG. 9 is a side view of the molded base used for the circuit breaker of FIG. 1.
Figure 10:
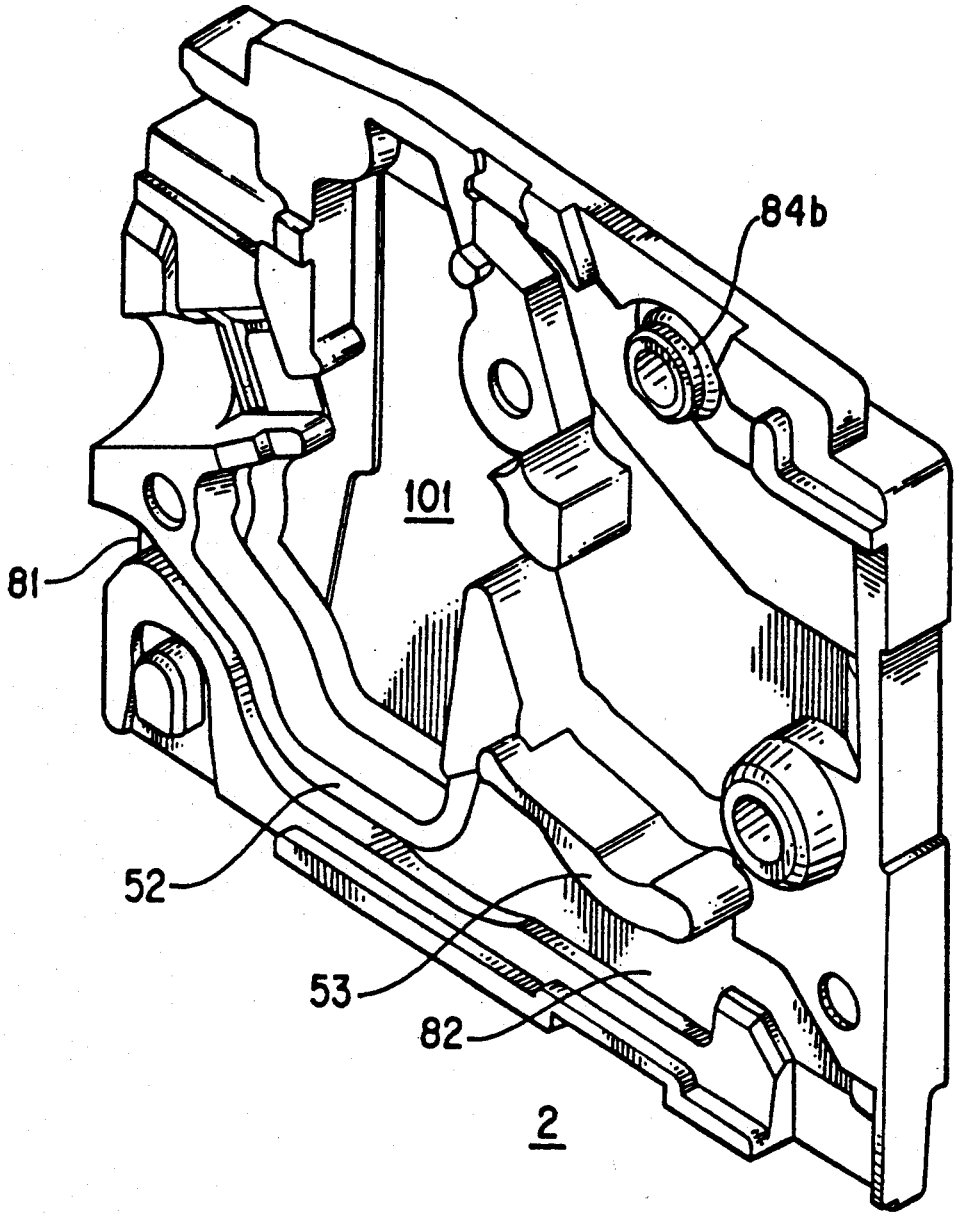
FIG. 10 is a front perspective view of the molded cover used for the circuit breaker of FIG. 1.
Figure 11:
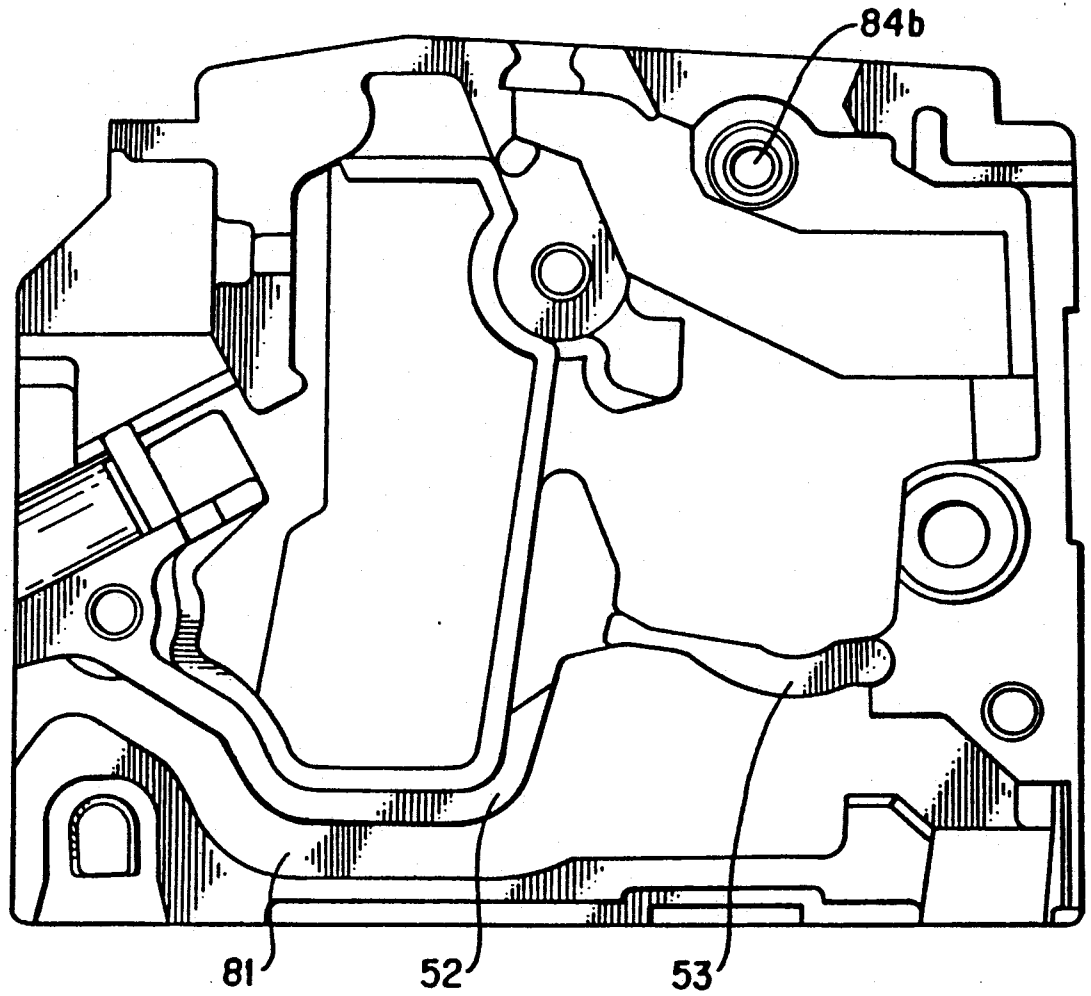
FIG. 11 is a side view of the molded cover used for the circuit breaker of FIG. 1.

Referring to FIGS. 1, 4–7, and 12, the operating mechanism of the circuit breaker is shown and constitutes those parts which operate the contacts of the circuit breaker between OPEN and CLOSED to make and break the electric circuit provided by the breaker. This operating mechanism includes a generally U-shaped trip lever member 31 pivotally supported at one end on a hub 32, which is formed during the molding of the base 1, and cooperating at the extremity of a latched end 34 with the metal latch clip 25 within the cutout 18 (FIG. 2) of the magnetic armature 17. A manual operator 35 having a handle portion 35*a* at one end thereof extending outwardly of the circuit breaker insulating base 1 and a body portion extending inwardly into a central recess 105 of the base 1 includes a pair of legs 36 (best shown in FIG. 12) between which the trip lever 31 extends substantially midway between the legs. Each of the legs 36 has an operator nub extending therefrom which forms an inward recess 37 for support of a movable contact carrier 41, as will be described. The manual operator 35 is provided with a central aperture 38 for cooperation with suitable molded trunnion extensions 84*a* and 84*b* (FIGS. 8 and 11) formed on the base 1 and cover 2, respectively, for the pivotal support thereof.

An integral movable contact carrier or blade 41 is pivotally attached to the manual operator 35 and includes two upwardly extending generally flat, parallel legs 42 cooperating with the inward recesses 37 of the legs 36 of the operator. From a central base portion 41*a* on the contact carrier 41 an upper portion 41*b*, having a toggle spring hook portion 77 extending away from the base portion 41*a*, is formed by a substantially perpendicular bend in the base portion 41*a*. The generally L-shaped legs 42 are formed from two additional perpendicular bends in the upper portion 41*b* of the movable contact carrier 41. A helical toggle spring 43 is secured to the toggle spring hook 77 at one end and the opposite end thereof is hooked to the trip lever 31 at a toggle hook 44 provided thereupon so that the tension of the toggle spring 43 maintains the legs 42 biased into engagement with the manual operator 35 within the recess 37.

Figure 5:
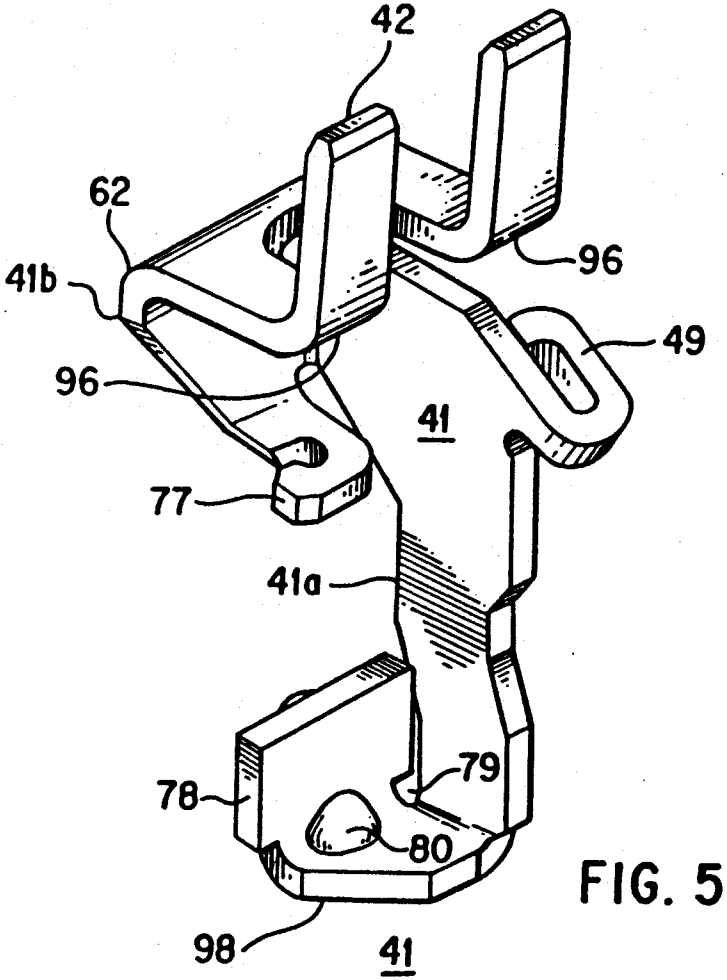
FIG. 5 is a front perspective view of the movable contact carrier used within the circuit breaker of FIG. 1.
Figure 4:
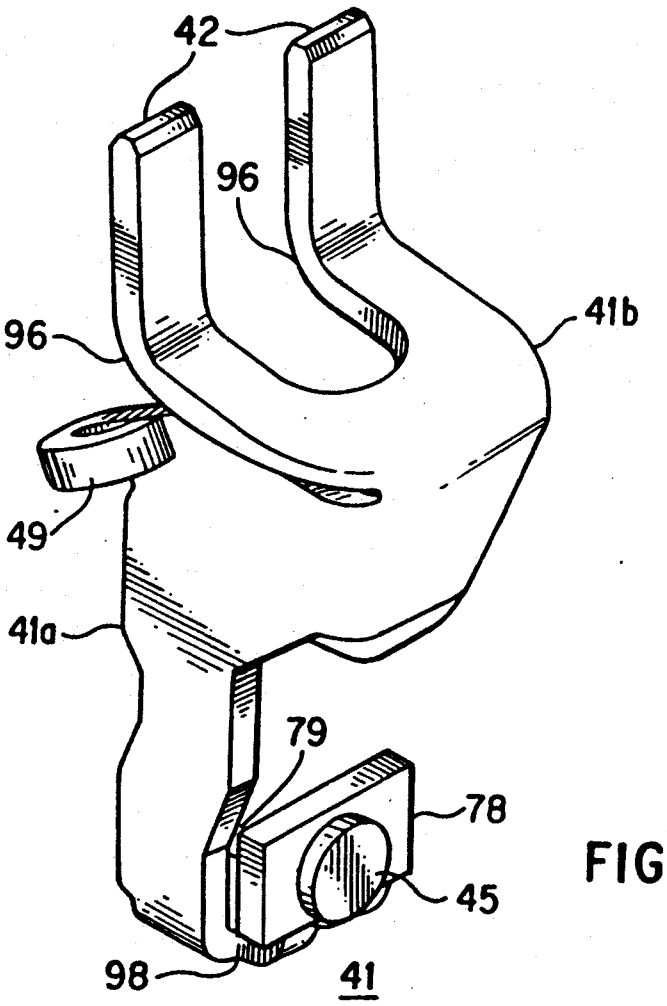
FIG. 4 is a rear perspective view of the movable contact carrier used within the circuit breaker of FIG. 1.
Figure 6:
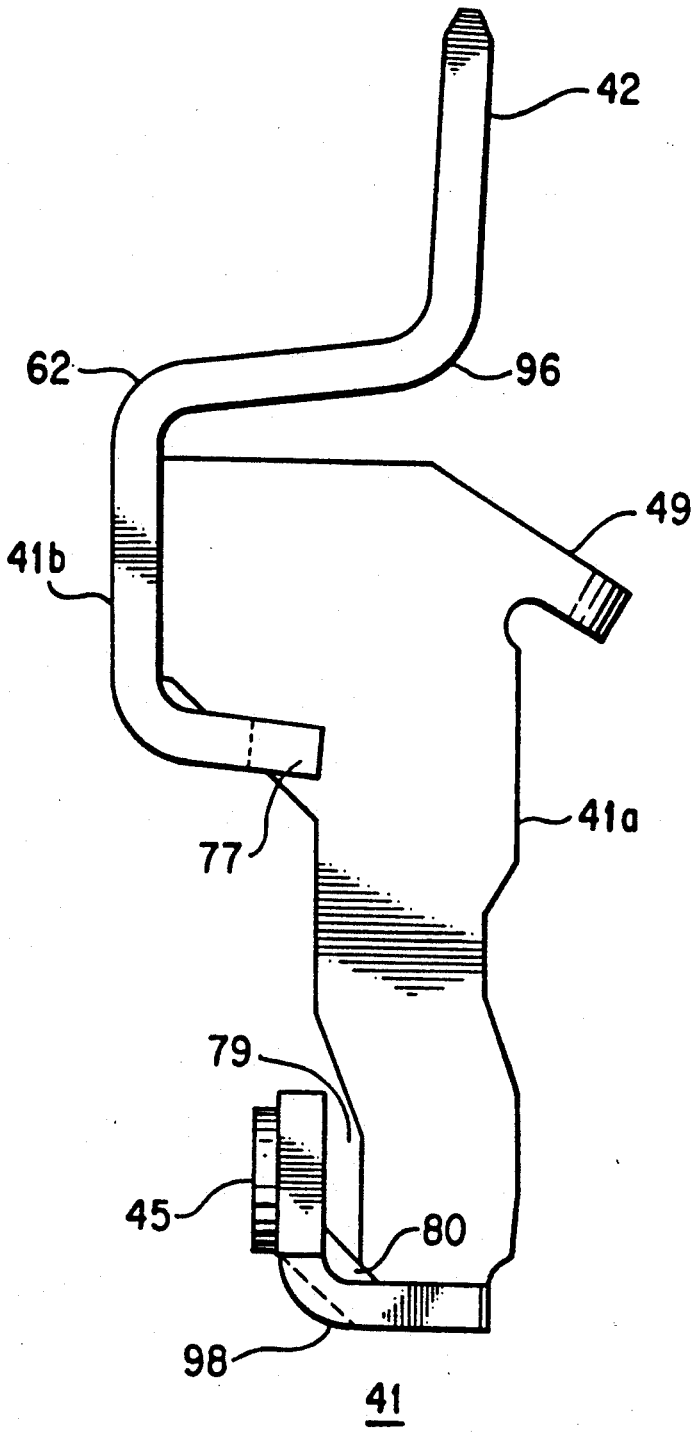
FIG. 6 is a side view of the movable contact carrier used within the circuit breaker of FIG. 1.
Figure 7:
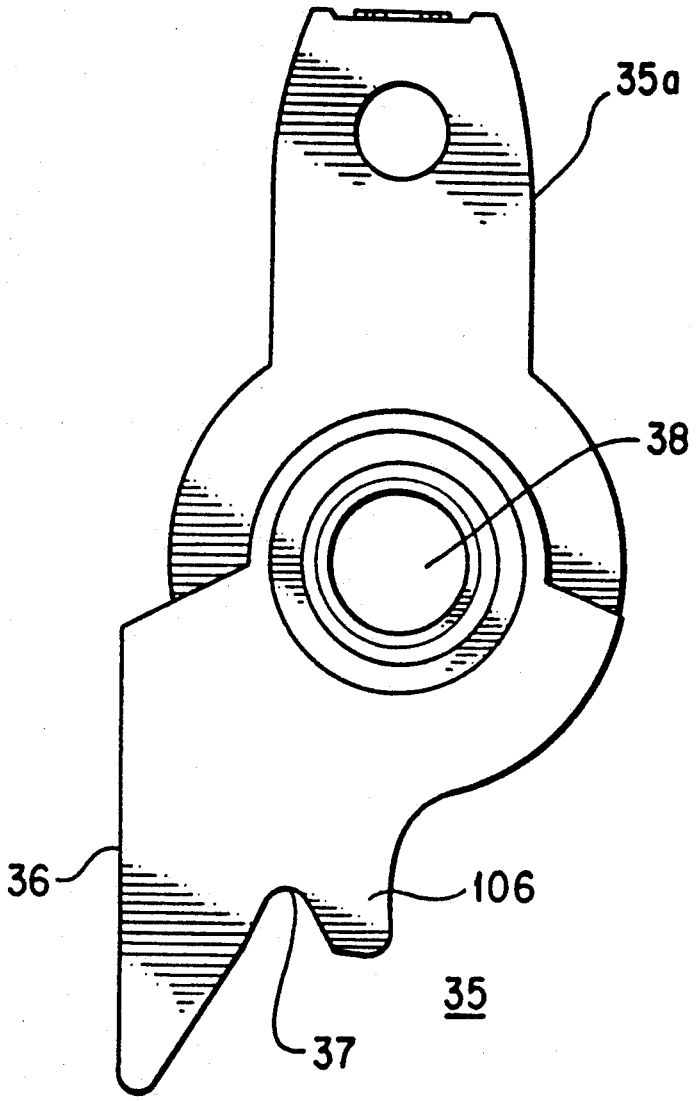
FIG. 7 is a side view of the manual operator used within the circuit breaker of FIG. 1.

A bent over integral heel-like extension 98 having a generally rectangular contact platform 78 extending therefrom is formed at the extreme lower portion of the movable contact carrier 41 at its end remote from the end carrying the legs 42. The heel-like extension and the contact platform 78 are formed by two consecutive substantially perpendicular bends in the base portion 41*a*. The platform includes a top portion distal from the extension 98 and also includes opposite side portions in close association with the bottom walls of the base and cover, respectively. As best seen in FIGS. 4-5, the first substantially perpendicular bend is toward the circuit breaker cover 2. The second bend positions the contact platform 78 substantially at a right angle to both the heel-like extension 98 and the contact carrier base portion 41*a* leaving a space portion 79 between the contact platform 78 and the base portion 41*a*. A strengthening rib 80, preferably vertically oriented, is formed about the second bend so as to mechanically strengthen the blade assembly and, more particularly, the transitional area between the extension area 98 and the platform 78. Preferably, the contact carrier is formed from an appropriately configured flat, stamped section of conductive material.

A contact 45 is secured to or otherwise defined upon the contact platform 78 and because of the movement of the contact carrier functions as a movable contact which cooperates with a stationary contact 46 secured to the base of a U-shaped terminal jaw clip 47 having the lower end 48 thereof extending beyond the base of the circuit breaker. The flexible conductor or pigtail 14 is secured at one end, as has been described, to the bimetallic member 11 and is also secured, by means such as welding at its other end, to the movable contact member 41 so that when the movable contact 45 engages the stationary contact 46, a circuit is complete from the terminal jaw clip 47 through the circuit breaker current response mechanism to the terminal screw 5. The movable contact carrier 41 is provided with an extending tab 49 integral therewith which is adapted to be turned back toward the base portion 41*a* of the carrier tightly against the flexible conductor 14 so as to substantially eliminate movement of the conductor at the point of the weld. It should be noted that the conductor is clamped to the movable contact carrier by the bent over tab 49 so that substantially all of the flexing of the flexible conductor takes place at the free side of the tab at a point removed from the point at which the flexible conductor 14 is welded to the contact carrier.

The above-described arrangement including the mutually perpendicular bends leading to the contact platform 78 and the definition of a gap or space portion 79 between the platform 78 and the base portion 41*a* of the contact carrier 41 contributes to enhanced performance of the carrier by providing improved arc erosion resistance and ability to stay intact during interruption faults. In conventional designs where there is no such gap, the forming connection is nominally made between the contact platform and the carrier base portion leading to erosion of material therebetween to the point where the carrier material could collapse under the contact. The novel design described herein avoids this erosion problem. Although some material erosion does occur around the sides or edges of the contact platform 78, the heel-like formed extension area 98, in combination with the strengthened area about the rib 80, offers increased strength and protection from arc effects.

In addition, the present design of the contact assembly is advantageous because the edges of the contact platform are maintained in close proximity to the arc chamber wall of the base and the wall of the cover. It has been noted that the closer the arc interruption wall is to the contact platform edges, the more responsive the contact carrier is during interruption. This is because the arc gases generated at the initial opening of the contacts cannot easily escape past the platform edges—as a result, the contact carrier is pushed to the OPEN position faster than would otherwise be possible. This faster opening action lowers the energy impacting the carrier, reduces stress imposed on other breaker components, and, consequently, increases the overall circuit breaker performance. The manner in which are gases are vented as the carrier approaches the OPEN position will be described in detail below.

Referring now to FIGS. 1 and 8–12, an arc chamber 82 is established in the circuit breaker about the area where the movable and stationary contacts are separated. This arc chamber 82 is defined by the bottom wall and sides of the base 1 and cover 2 adjacent the contact area, and the stationary contact carrier or terminal jaw clip 47 having the stationary contact 46 secured thereto at one end and supplemental barriers 51 and 52, respectively, in the base 1 and cover 2. The upper extremity of the arc chamber 82 is established by a barrier 53 formed in the cover 2. When the cover 2 is secured to the base 1 the barrier 53, together with the bottom and sides of the base and cover and exhaust barriers, substantially encloses the area wherein the contacts are separated so as to channel any arc, as well as associated gasses which may be generated upon contact separation, away from the operating components of the circuit breaker. A plurality of dielectric grooves 83 are formed in the base 1 to provide proper insulation and dielectric withstand to prevent current from flowing across the base 1 after short circuit interruptions. An exhaust venting chute 81 is established by the bottom and sides of the base 1 and cover 2 and exhaust barriers 51 and 52 in the base 1 and the cover 2, respectively. The exhaust venting chute 81 allows arc gases to escape away from the internal components and areas of the circuit breaker containing the operating mechanism.

The above-described design is advantageous in that it obviates the problematic need in conventional circuit breaker designs for a slide fiber in order to protect the rear portion of the movable contact carrier or blade from any arc and associated gases generated between the stationary and moveable contact during fault interruption. Such a slide fiber is generally attached to the rear section of the contact carrier and poses breakage and operational continuity problems. In addition, the added mass of the fiber blade makes the contact carrier or blade slower and less responsive during fault interruption, thereby generating detrimental increased energy output through the breaker. With the subject design, the exhaust barrier 53 in the cover 2 which defines part of the arc chamber functions to protect the rear portion of the contact carrier without any need for a protective slide fiber. When the cover 2 is closed onto the base 1, the bottom surface of the barrier 53 (see FIG. 10) covers up the rear portion of the carrier substantially along its entire path of movement between the OPEN and CLOSED positions, while leaving the necessary opening or gap to permit the requisite sliding movement of the carrier.

The circuit breaker described above is also provided with positive opening means to insure that the electrical contacts are opened as required even if the contacts happen to be partially welded or otherwise stuck together during operation. As seen in FIGS. 1, 4–6 and 12–14, this is accomplished by providing a nub 61 on the trip lever 31 and a first shoulder 62 centrally of the upper portion 41*b* of the movable contact carrier 41. In manual circuit breaker opening and closing, as can be seen in the drawings and as will be explained hereinafter, these surfaces 61 and 62 normally do not engage each other, but on tripping movement of the trip lever 31 as the toggle spring 43 is moved through its "overcenter" position, the nub 61 engages the shoulder 62 in a hammering fashion to drive the contacts 45 and 46 apart before the toggle spring 43 passes through the "overcenter" position to initiate opening of the circuit breaker. Continued opening movement of the contacts is then effected by the toggle spring 43.

Figure 14:
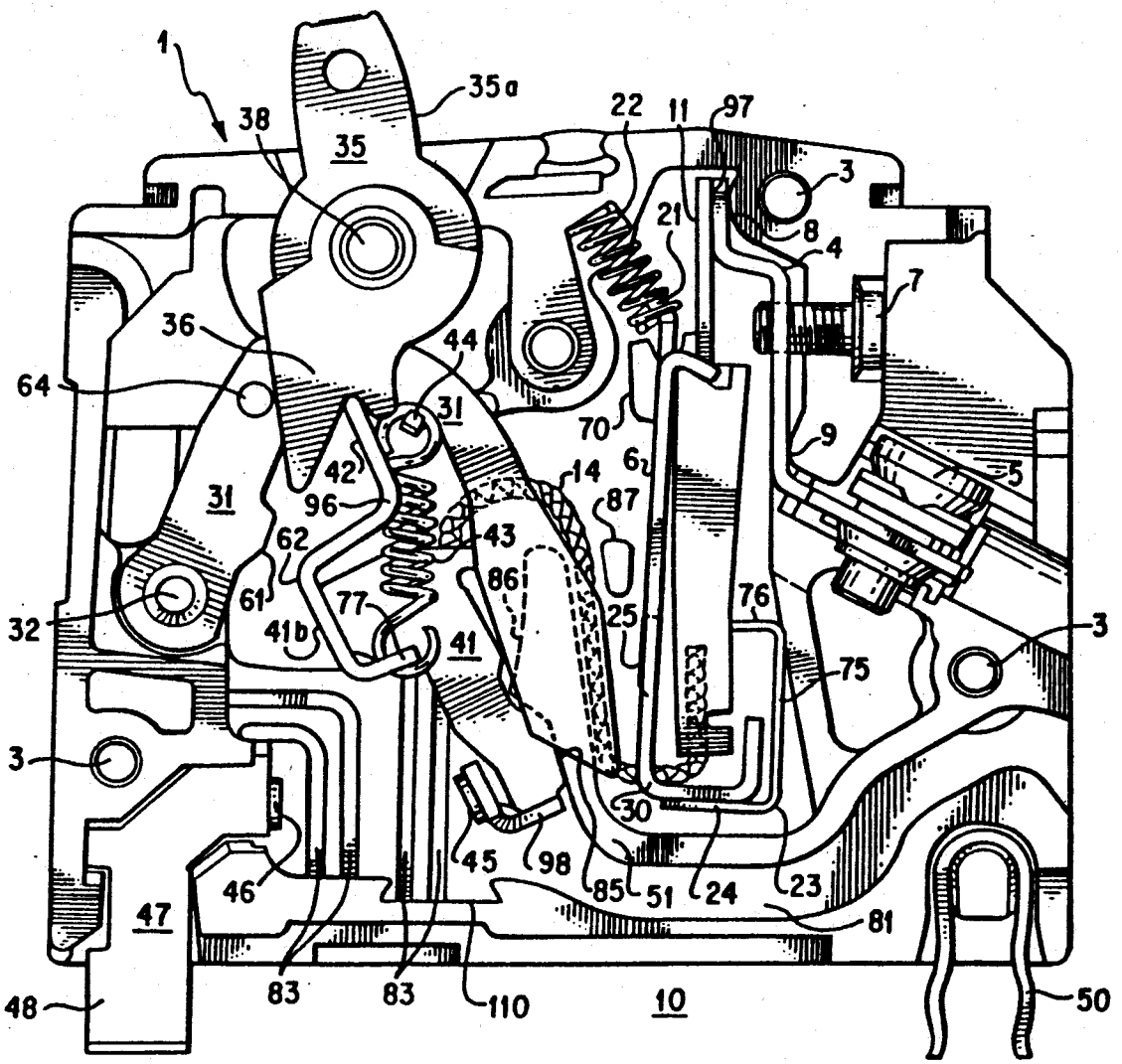
FIG. 14 is a side view of the circuit breaker as shown in FIG. 1 with the cover removed showing the operating mechanism in the TRIPPED position.

Resetting means are provided for the circuit breaker to return the mechanism to the normal operating condition after an overload has occurred. Referring to FIG. 14 wherein the circuit breaker is shown in TRIPPED position, it is apparent that the latched end 34 of the trip lever 31 must be returned to its latched position on the metal latch clip 25 in the cutout 18 of the armature 17. To accomplish this movement, a removeable trip lever reset pin 64 is provided in an aperture in the trip lever 31 and is adapted to be in cooperative relationship with the pair of integral legs 36 of the manual operator 35. As shown in FIG. 14, the removeable trip lever reset pin 64 is adjacent to the legs 36 so that upon movement of the manual operator to the OPEN or latched position (see FIG. 13) the trip lever will be rotated about its pivot hub 32 to carry the latched end 34 of the lever 31 into relatched position on the armature 17 due to the cooperation of the removeable trip lever reset pin 64 with the legs 36 of the manual operator 35.

The circuit breaker of the present invention is designed to be mounted in a panelboard, load center, or other current distribution device through the cooperation of spring jaw clips at the base. As shown in FIG. 1 this function is provided by the terminal jaw clip 47 at one end of the circuit breaker and a second spring jaw 50 at the opposite end, both extending beyond the exterior of the circuit breaker. The axes of these spring jaw clips are rotated 90° with respect to each other so that the jaw 50 may engage a continuous strip type mounting device and the lower end 48 of the terminal jaw clip 47 may engage an isolatable terminal within the associated panelboard, load center, or other current distribution device. Both jaws are supported within the base and cover through cooperating grooves and bosses and are securely held when the cover 2 is riveted in place to form the enclosure which houses the circuit breaker mechanism.

Figure 15:
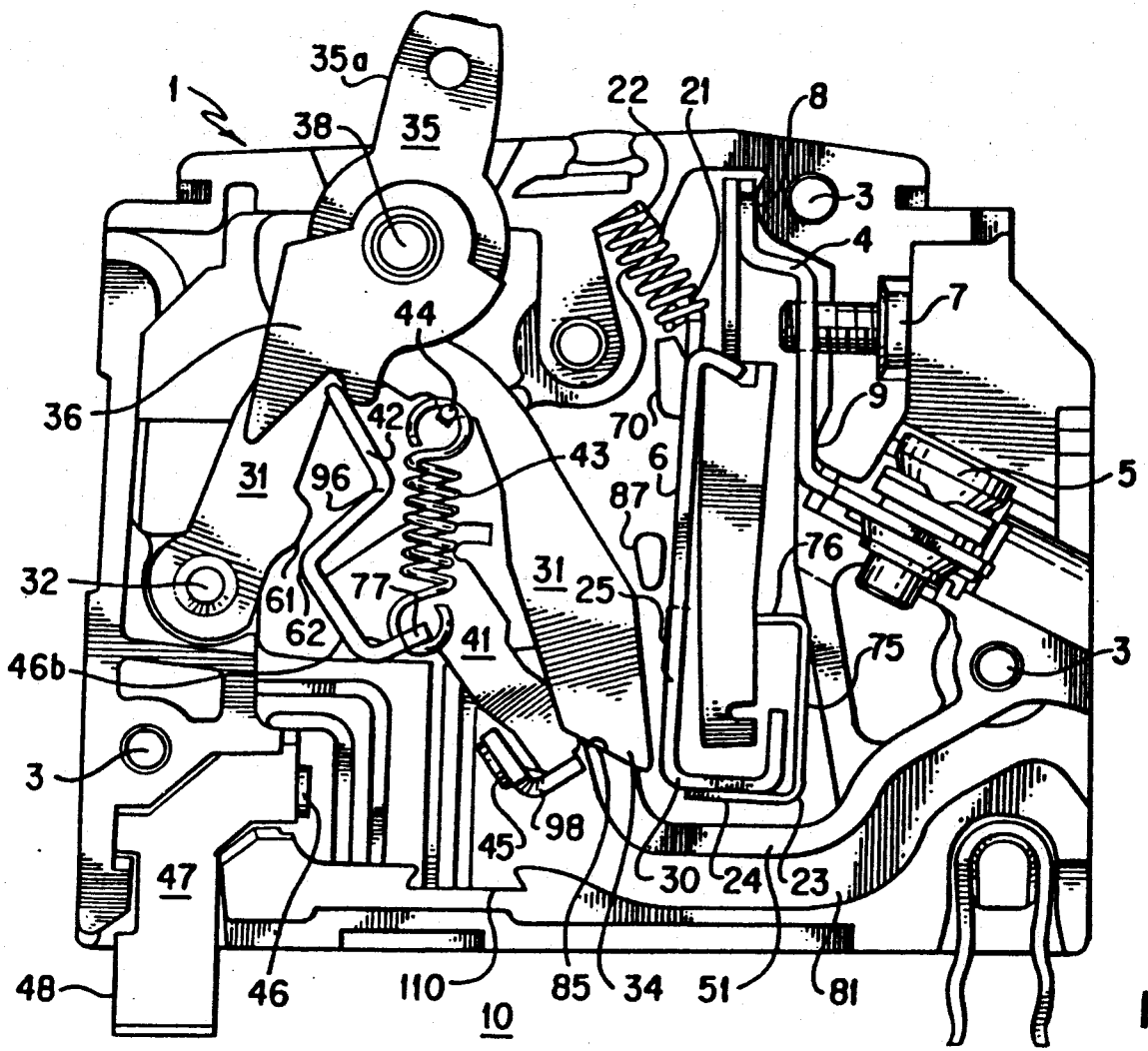
FIG. 15 is a side view of the circuit breaker as shown in FIG. 1 with the cover removed showing the operating mechanism in the TRIPPED position and having the removable trip lever reset pin removed.

The current responsive overload mechanism 6 operates to open the circuit breaker contacts in response to a sustained moderate overload and in response to an instantaneous extreme overload, or short circuit, in the manner which will now be described. In particular, FIGS. 1-3 show the path of current through the circuit breaker whereby current initially flows through the current responsive bimetallic member 11. Upon sustained moderate overload, the bimetallic member 11 deflects about the point 97 where it is in fixed engagement with the conducting load terminal 4 so as to move the opposite end of the member 11 in a counterclockwise fashion with respect to its fixed end. This movement of the bimetallic member 11 is translated to the magnetic yoke member 12, and also causes the ambient temperature compensation bimetal 23 to move correspondingly due to the action of the tab 76 thereupon. Since the opposite end of the ambient temperature compensation bimetal 23 is secured to the magnetic armature member 17, the armature is moved on sustained moderate overloads so as to move the latching surface of the latch clip 25 away from its cooperative engagement with the latched end 34 of the trip lever 31. Upon release of the flip lever 31 from the latch clip 25, the trip lever 31 moves in a clockwise fashion about its pivot hub 32 to carry the end of the coil toggle spring 43 attached to the trip lever 31 at the trip lever toggle hook 44 to the other side of the pivotal engagement of the legs 42 within the recess 37 of the manual operator 35. The clockwise movement of the trip lever 31 is limited when the latched end 34 engages a trip lever stop surface 85 of the barrier 51 (FIG. 15).

Once the toggle spring 43 has moved through this line of pivot, the bias of toggle spring 43 and the camming action of nub 61 with shoulder 62 become operative to rotate movable contact carrier 41 in a counterclockwise fashion about its pivot in the recess 37 of the manual operator 35 to open the contacts 45 and 46 with a snap action. The resulting TRIPPED position is shown in FIG. 15. In a similar manner, upon occurrence of an extreme overload, the flow of current through the bimetallic member 11 sets up a magnetic force in the magnetic yoke 12 which attracts the armature 17 against the pole faces or side legs 92, 93 of the magnetic yoke 12 to instantaneously release the trip lever 31 from its engagement with the latch clip 25. This causes corresponding movement of the toggle spring 43 and movable contact carrier 41 to open the contact between the contacts 45 and 46. It should be noted that the contacts 45 and 46 will be separated upon overload in the manner described regardless of whether the manual operator 35 is held in its ON position or allowed to move with the trip action, making the circuit breaker t-rip-free in action.

Ambient temperature compensation is provided in the current responsive mechanism 6 of the circuit breaker through the construction of the ambient temperature compensation member 23 formed of a bimetallic material arranged so that its leg portion 75 moves away from the magnetic yoke 12 on high ambient conditions and toward the yoke 12 on low ambient conditions. The movement of the ambient temperature compensation bimetal 23 permits the armature 17 to remain substantially in the same position at all ambient temperatures by letting the leg 75 move substantially the same distance that the free end of the current responsive bimetal 11 will move due to an increase or decrease in ambient temperature.

The circuit breaker described above is also provided with means for preventing entanglement of the trip lever 31 with the flexible conductor 14 during a TRIP operation. Referring in particular to FIGS. 1, 8, 9, and 14, flexible conductor barriers 86 and 87 are integrally formed in the base 1 for providing retention of the flexible conductor 14 therebetween and also between the trip lever 31 and the bottom wall 101 of the base to prevent the flexible conductor 14 from being entangled with the trip lever 31 during a short circuit TRIP operation. The arrangement is such that the trip lever 31 rests on the top surface of the flexible conductor barrier 86, thereby preventing the flexible conductor from moving around the trip lever.

When a short circuit occurs, the tendency of the flexible conductor 14 to rise up as previously described is prohibited because it engages the flat back side of the trip lever 31 and is retained below the trip lever. At no time during the TRIP operation does the flexible conductor have the opportunity to position itself in the path of or on top of the trip lever. FIG. 14 shows the circuit breaker and, more specifically, the trip lever 31 in the TRIPPED position. As shown, the trip lever 31 rests at the trip lever stop surface 85 on the barrier 51 with the flexible conductor 14 still securely under the trip lever. As can also be seen in FIG. 15, the flexible conductor is retained under the trip lever and can not position itself in front of the trip lever. This avoids the problem of delayed tripping since the trip lever can freely rotate to its normal tripped position without contacting the flexible conductor.

The removability of the trip lever reset pin 64 facilitates automating the assembly of the circuit breaker of the present invention by providing a means to Z-axis install the helical toggle spring 43. FIG. 14 represents the circuit breaker with the removable reset pin 64 installed into the trip lever 31. The manual operator 35 and trip lever 31 are positioned in the TRIPPED position. The removable trip lever reset pin 64 obstructs the manual operator and, thus, the movable contact carrier 41 in the position shown. With the pin so positioned, the toggle spring 43 can not be easily removed, or installed, because of the interference created by the formed shoulder 96 on one of the extending legs 42.

FIG. 15 represents the circuit breaker of FIG. 14 without the removable trip lever reset pin 64 being installed in the trip lever 31. As shown, when the reset pin is not installed in the trip lever 31 the trip lever remains in the same position but the manual operator 35 is allowed to rotate clockwise moving the movable contact carrier extending legs 42 upwardly and moving the second formed shoulder 96 away from the toggle spring 43. The resulting position leaves the trip lever toggle hook 44, the spring hook 77 and the toggle spring 43 available for Z-axis assembly of the spring to the hooks without interference. After the toggle spring 43 is installed the reset pin 64 is installed into an aperture provided in the trip lever 31.

This arrangement is advantageous compared to conventional automated designs of residential circuit breakers which use an up-formed tab to perform the function described above for the removable trip lever reset pin. Such an up-formed tab restricts automation of the toggle spring because it is not possible to remove the tab momentarily to install the toggle spring and then reattach the tab as a functional part. This problem is solved by the use of the removeable reset pin since it can easily be inserted after the toggle spring is attached, thereby allowing automated assembly.

The above-described circuit breaker is also provided with means for accurate positioning of the contact carrier or blade 41 as part of the automated assembly of the blade-bimetal terminal combination. As described above, the contact carrier or blade is coupled to the flexible pigtail wire 14; accordingly, it is difficult for the blade assembly to be precisely located and secured from movement during the assembly process. To solve this problem, the base 2 of the circuit breaker is provided with a dovetail groove or slot 1 10 built into the base. During assembly, the dovetail groove is adapted to receive therein a correspondingly-shaped blade holder (not shown) which carries the blade assembly as it is positioned into the case 2. The dovetail groove 110, thus, functions as a precise locator on the basis of which the blade can be held in position while the other circuit breaker components including the manual operator 35, the trip lever member 31, the armature member 17 and the associated springs, are loaded automatically according to the Z-axis assembly process described above.

What is claimed is:

1. An electric circuit breaker comprising:

a base;

a cover operatively associated with said base to form an enclosure;

a line terminal carried by said base;

a load terminal carried by said base;

an electrical circuit extending between said line terminal and said load terminal, said electrical circuit comprising;

a first contact;

a second contact;

a movable contact carrier carrying said second contact and movable between (i) a first position wherein said second contact is engaged with said first contact and corresponding to a closed electrical circuit condition wherein said electrical circuit is completed between said line terminal and said load terminal and (ii) a second position wherein said second contact is spaced away from said first contact and corresponding to an open electrical circuit condition wherein said electrical circuit is not completed between said line terminal and said load terminal;

operating means for moving said contact carrier from said first position to said second position;

said operating means including a current responsive means associated therewith for releasing said operating means to move said contact carrier from said first position to said second position in response to predetermined current conditions;

said current responsive means comprising a bimetal member connected at one end to said load terminal;

a yoke connected to an opposite end of said bimetal member, said yoke having a back portion, and a pivot support portion and a cradle slot portion extending therefrom;

a flexible conductor connected at a first end to said yoke, said flexible conductor being wrapped around said yoke and having an opposite end connected to said contact carrier; and an armature operatively associated with said yoke, said armature including a face plate, a first end of said face plate having an angularly disposed pivot tab adapted to be supported on said pivot support portion and a rocker portion adapted to be received in said cradle slot portion so as to pivotably support said armature on said yoke, said face plate further having a cut out central portion adapted to receive said trip lever.

2. An electric circuit breaker as claimed in claim 1, wherein a second end of said face plate includes a hook-shaped extension defined by a first leg extending approximately 90° to said face plate and a second leg extending approximately 90° to said first leg and essentially parallel to said face plate, said extension adapted to be positioned in wrap-around relationship to said yoke.

3. An electric circuit breaker as claimed in claim 2 further including a bimetallic compensator connected to said armature, said compensator including a first leg portion (24) connected to said hook-shaped extension at said first leg thereof and a second leg portion (75) extending approximately 90° to said first compensation leg portion and a tab (76) extending approximately 90° to said second leg so as to extend toward said back portion of said yoke where said armature is pivotably supported upon said yoke.

4. An electric circuit breaker as claimed in claim 3, wherein said first end of said face plate includes a pair of shoulder portions and an arm extending outward from therebetween at an offset angle; and a bias spring having one end engaged with said shoulder portions about said arm and having an opposite end engaged with said base, said spring biasing said armature toward a position wherein said tab (76) is pressed into engagement with said back portion of said yoke.

* * * * *